US007273428B2

(12) United States Patent
James

(10) Patent No.: US 7,273,428 B2
(45) Date of Patent: Sep. 25, 2007

(54) BASEBALL RETRIEVAL APPARATUS

(76) Inventor: Barry D. James, 656 Sugarvalley SW., Carterville, GA (US) 30120

( * ) Notice: Subject to any disclaimer, the term of this patent is extended or adjusted under 35 U.S.C. 154(b) by 0 days.

(21) Appl. No.: 11/235,847

(22) Filed: Sep. 27, 2005

(65) Prior Publication Data

US 2007/0072703 A1 Mar. 29, 2007

(51) Int. Cl.
*A63B 69/00* (2006.01)
*A63B 69/40* (2006.01)

(52) U.S. Cl. ..... 473/431; 473/142; 473/423; 473/422

(58) Field of Classification Search ..... 473/417, 473/422–426, 437, 451; 124/16, 34, 38
See application file for complete search history.

(56) References Cited

U.S. PATENT DOCUMENTS 3,168,312 A * 2/1965 Davis ..... 473/423
4,129,110 A * 12/1978 Kubrak ..... 124/16
4,278,257 A * 7/1981 Garcia et al. ..... 473/423
5,415,396 A * 5/1995 Huang ..... 473/417
5,853,334 A * 12/1998 Winebrenner ..... 473/142
5,957,788 A * 9/1999 Eze ..... 473/422
6,398,671 B1 * 6/2002 Rios ..... 473/417
7,014,577 B2 * 3/2006 Van Asselt ..... 473/423

* cited by examiner

*Primary Examiner*—Mitra Aryanpour
(74) *Attorney, Agent, or Firm*—Harry I. Leon; Vivian L. Steadman

(57) ABSTRACT

An apparatus for supporting a tethered baseball in position for batting practice and automatically retrieving the ball after it has been hit with a bat, which includes an adjustable height stand, a fishing reel and a variable speed motor connected thereto. Tethered by a small gauge fishing line which is attached to the reel, the ball, prior to being hit, rests atop the adjustable strand. When the ball is hit, the line is released nearly effortlessly from the reel; and the ball is allowed to travel virtually unobstructed during its flight. When the ball has traveled its full distance, the batter, by pushing a switch with a foot pedal, starts the motor, causing the reel to rewind the line. A control on the switch allows the batter to vary the speed of the motor from fast when the ball is at a distance to slow when the ball approaches the batter.

4 Claims, 5 Drawing Sheets

BASEBALL RETRIEVAL APPARATUS

BACKGROUND OF THE INVENTION

The present invention relates to an apparatus for improving the skill and strength of a baseball batter using a tethered baseball. In the prior art, such apparatus is described in U.S. Pat. Nos. 6,024,657; 5,795,250; 5,662,537; 3,994,494 and 3,953,028. Each of these prior art devices only allows the struck ball to travel a relatively short distance. There is a need for an apparatus which allows a batter to hit a ball that can travel a long distance and still be tethered for ease of retrieval.

SUMMARY OF THE INVENTION

The object of this invention is to provide for training a baseball player by furnishing an improved apparatus which, after a baseball has been hit by a bat, not only will automatically retrieve the baseball but also, unlike the prior art, allows the baseball close to free travel. With the apparatus, one person can practice batting without having to spend time retrieving the ball after each hit and over relatively long distances.

The apparatus comprises a fishing reel or equivalent, a fishing line releasable from the reel, a baseball tethered to the line and a variable speed motor. Activated by a foot controlled switch, the variable speed motor is employed to rewind the reel. To further assist the batter, the apparatus has an adjustable height ball holder.

In use, the batter hits the ball; and the ball travels nearly freely until it reaches the end of its travel path. Then the user activates the foot switch to start the retrieval. Preferably, when the ball is far from the apparatus, one runs the motor at a high rate of speed and then slows it down as the ball approaches the reel. A net is also provided to catch the retrieved ball.

DETAILED DESCRIPTION OF THE PREFERRED EMBODIMENT

Figure 1:
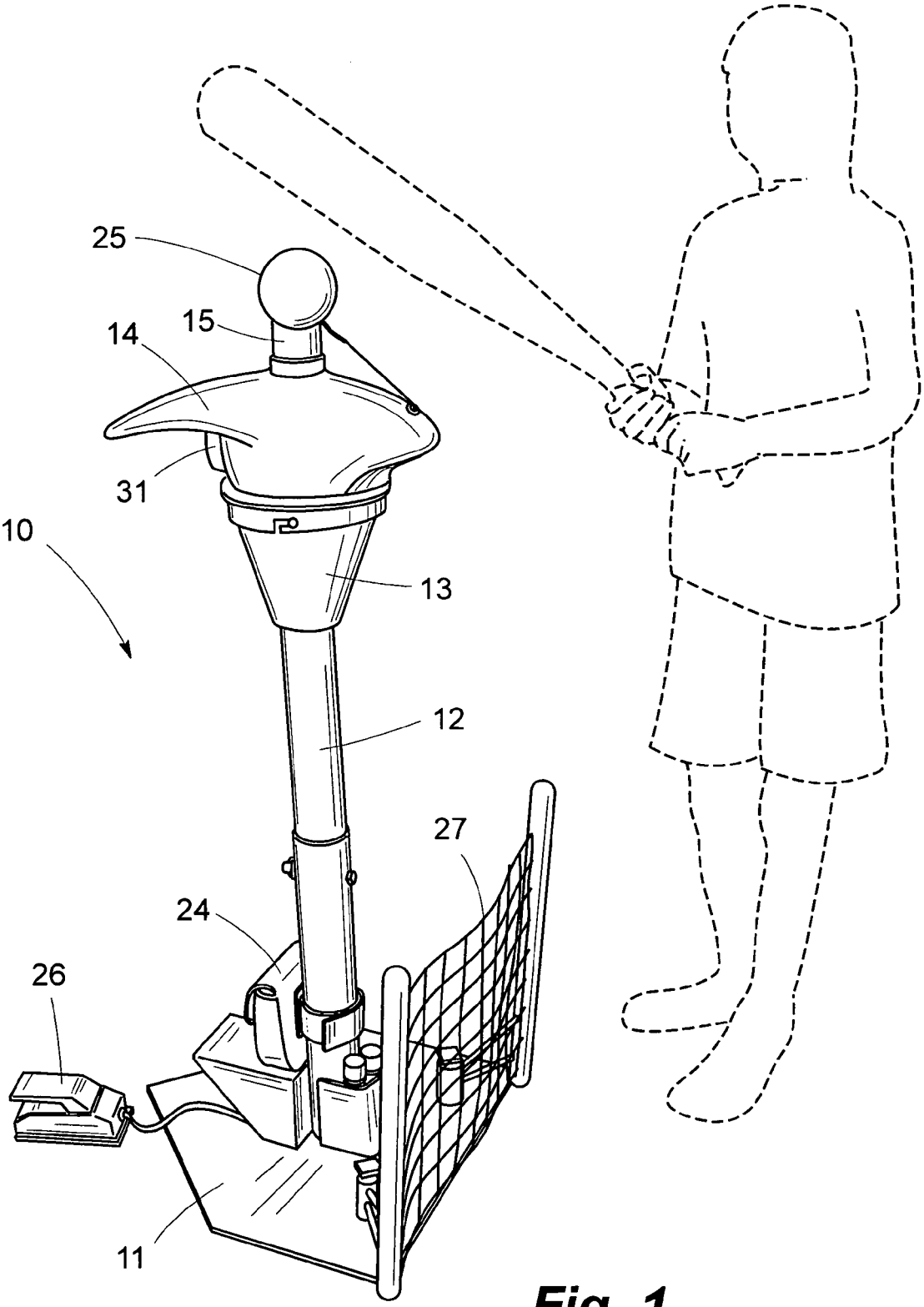
FIG. 1 is a right side perspective view of the ball retrieval apparatus according to the present invention, with the ball resting on the apparatus ready for batting, the bat and batter being shown in dashed lines for illustrative purposes only and not being part of the apparatus.

In the drawings, an improved apparatus for helping with batting practice is indicated generally by the reference numeral 10. The apparatus 10 has a support structure comprising a weighted foot 11, a telescopic leg 12, a lower housing 13, an upper housing 14 and a ball support 15. Most of the weight of the apparatus 10, which, by way of example, weighs about 30 pounds, resides in the foot 11. The telescopic leg 12 preferably allows one to extend the apparatus 10 upwardly from its fully retracted position by about 16 inches—from 24 to 40 inches. Not only is the height of the leg 12 adjustable so that a ball 25 can be held at various elevations throughout an individual batter's strike zone, but also the apparatus 10 can be positioned so as to simulate both inside and outside "pitches" for a particular batter.

The upper housing 14 is streamlined in shape to minimize the likelihood of the batter inadvertently hitting the apparatus 10 instead of the ball 25.

The lower housing 13 supports a reel 16 with a spool for holding a fishing line 17. The distal end of the line 17 is attached to the baseball 25. A motor 18 having a drive train 19 is attached to the reel 16. When the motor 18 is activated, the line 17 is rewound on the reel 16. In the preferred embodiment, the motor 18 is battery powered by batteries 21 mounted in a holder 22.

In use, the ball 25 rests initially on the support 15 atop the upper housing 14. The holder 15 is fabricated from a flexible hose that is slip-fitted into a hole in the upper housing 14. A suitable holder 15 can be made from a 3 inch long section of a 1½ inch diameter automobile radiator hose.

After the ball 25 resting on the support 15 has been hit by the bat 40, the ball then travels with little restraint from the line 17 as it leaves the reel 16. As a consequence, the batting practice afforded by the apparatus 10 simulates the "real game". The ball 25 is retrieved by activation of the variable speed control 26 for the motor 18. In the preferred embodiment, the control 26 is a foot pedal switch.

Figure 2:
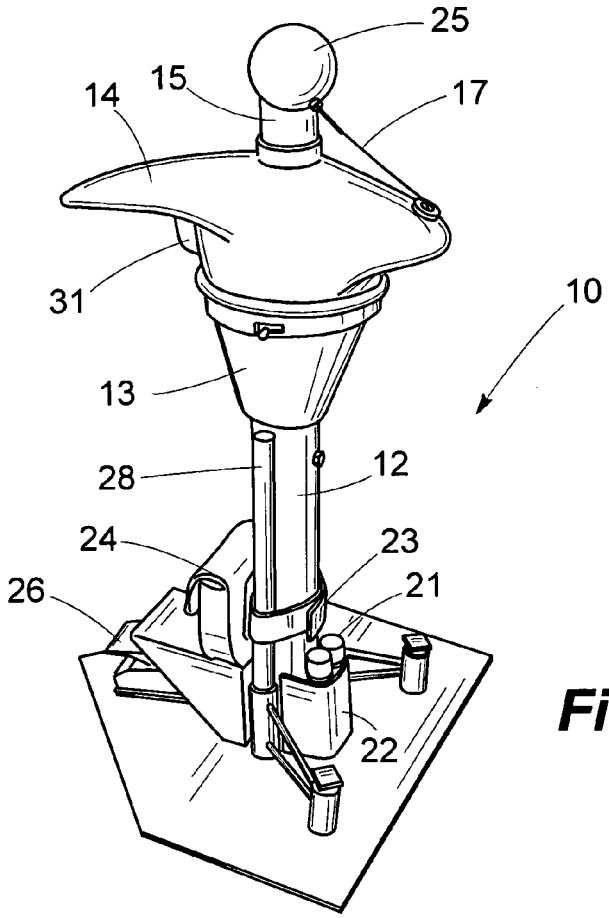
FIG. 2 is a closeup right side perspective view of the apparatus according to FIG. 1, with the adjustable height ball holder being fully retracted and the catch net and its posts being disposed in their respective stored positions.
Figure 3:
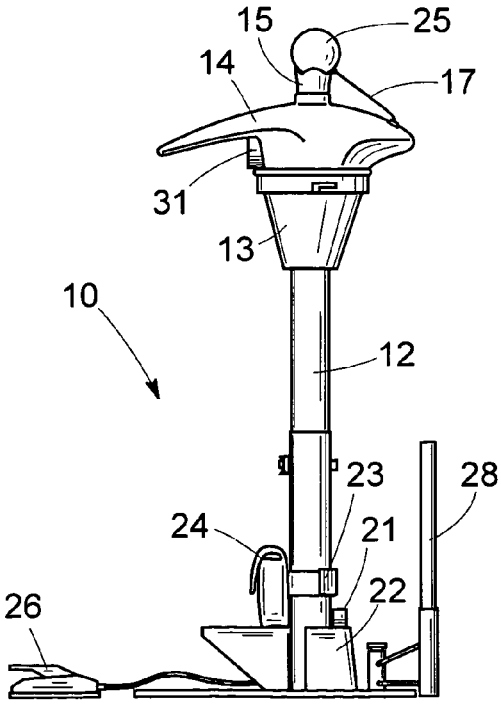
FIG. 3 is a side elevational view of the apparatus according to FIG. 1.
Figure 4:
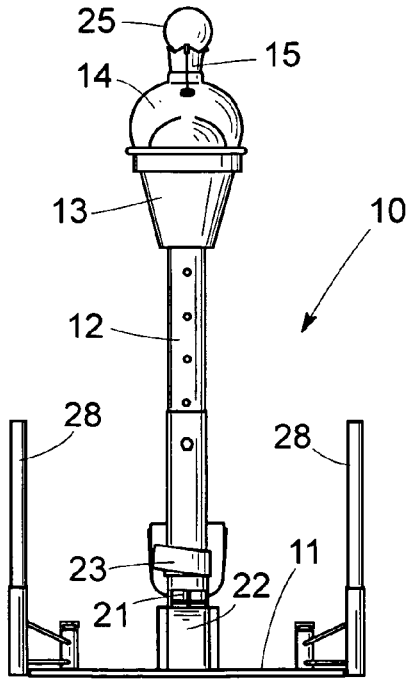
FIG. 4 is a front elevational view of the apparatus according to FIG. 1 but with the catch net removed for ease of illustration.
Figure 5:
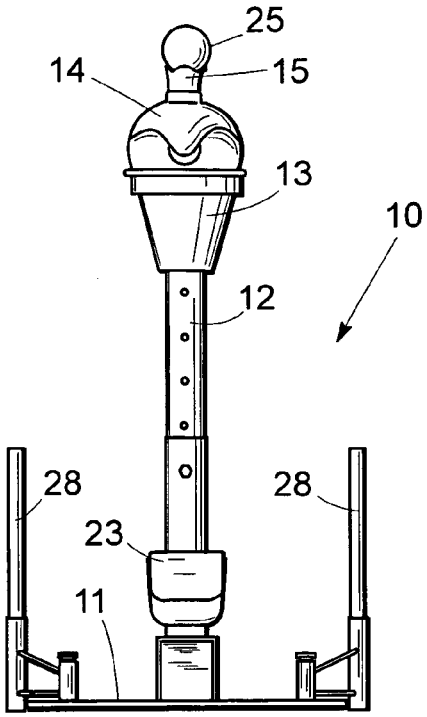
FIG. 5 is a rear elevational view of the apparatus according to FIG. 4.
Figure 6:
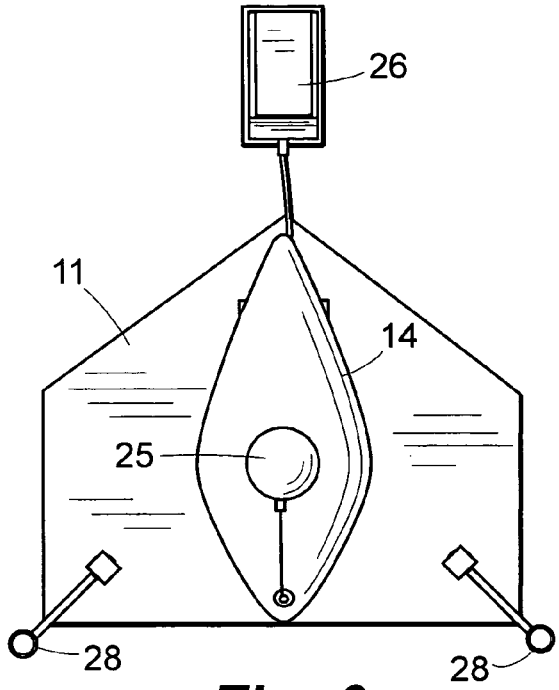
FIG. 6 is a top plan view of the apparatus according to FIG. 4.
Figure 7:
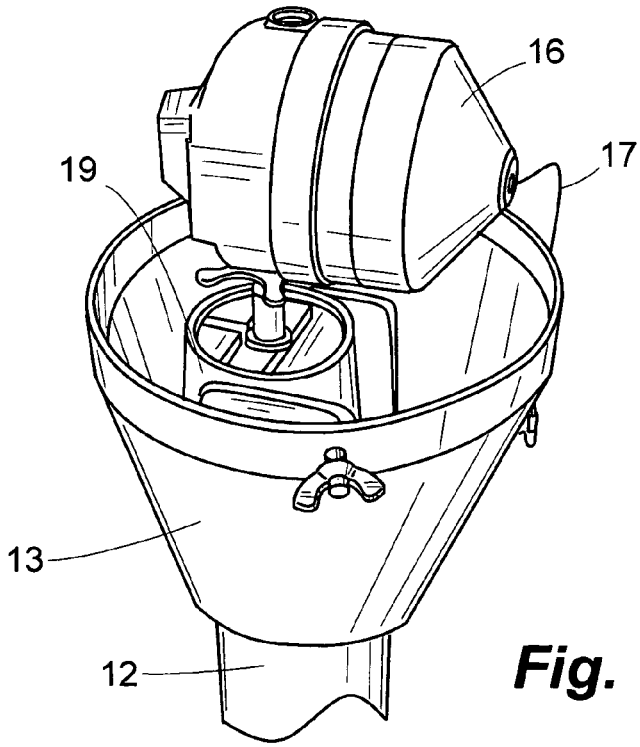
FIG. 7 is a closeup view of a fragment of the apparatus according to FIG. 1, the upper housing having been removed and showing the motor mounted within the lower housing and the reel connected thereto.

When the ball 25 is a long distance from the user, a high speed setting on the control 26 can be used; then the speed is preferably reduced as the ball approaches a catch net 27 supported by posts 28 mounted on the foot 11. When not in use, the net 27 is stored in a pouch 24 secured to the leg 12 with a strap 23 (FIGS. 2-4).

Figure 8A:
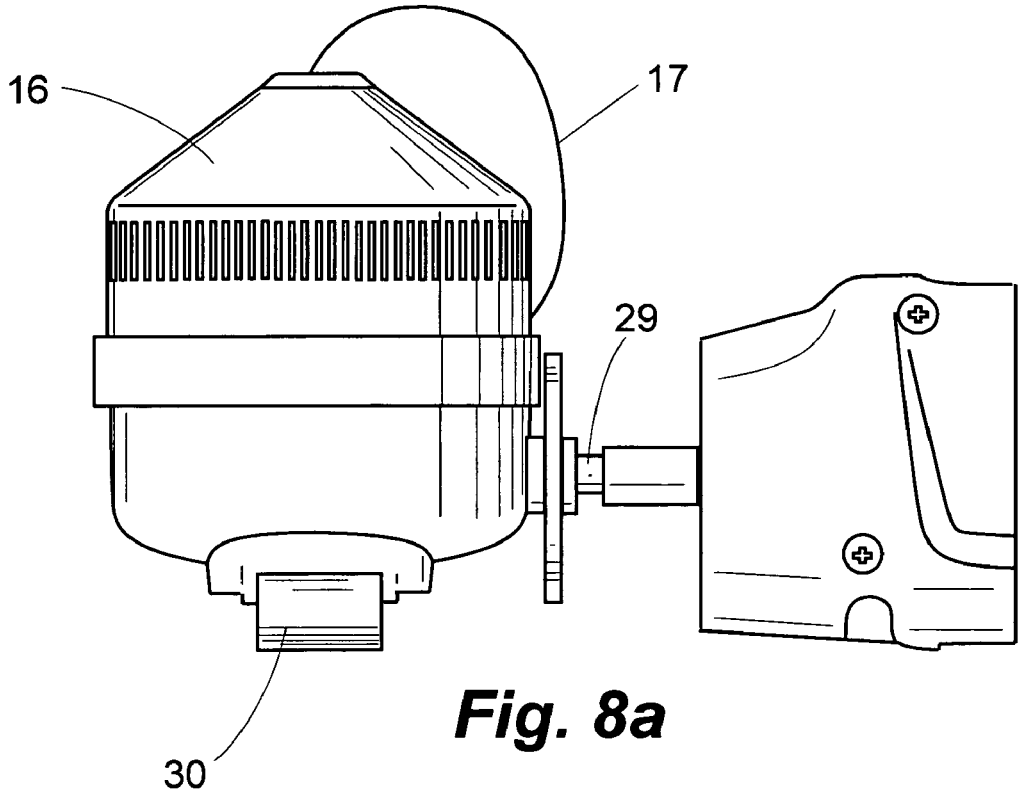
FIGS. 8*a* and 8*b* are closeup views of the reel attached to the gear box in the apparatus according to FIG. 1, with the gear box housing covered and uncovered, respectively.
Figure 8B:
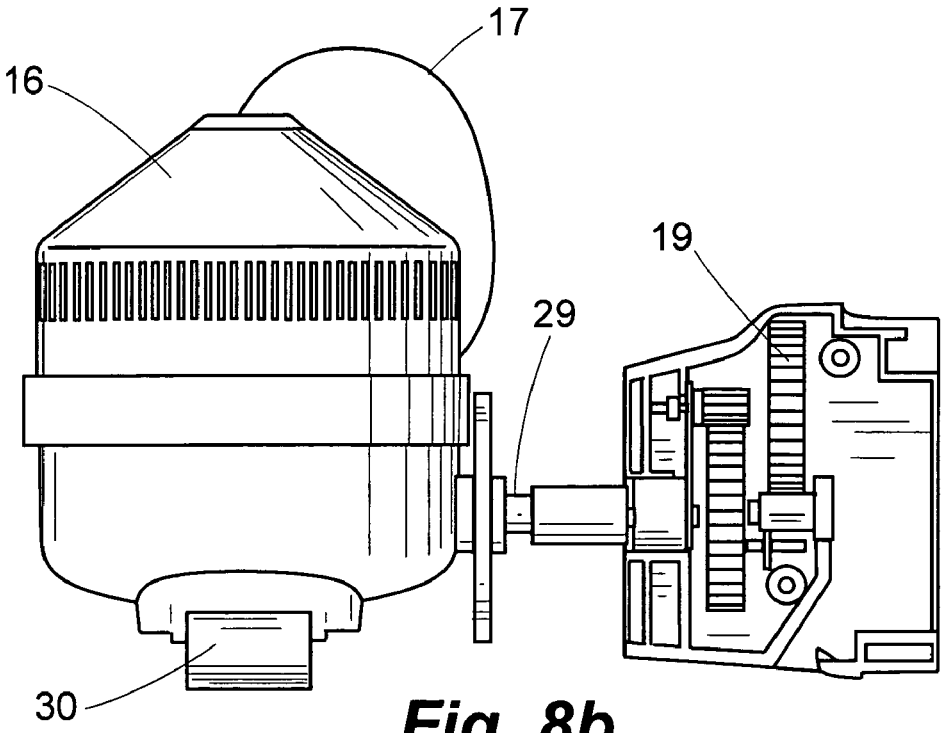
Figure 9:
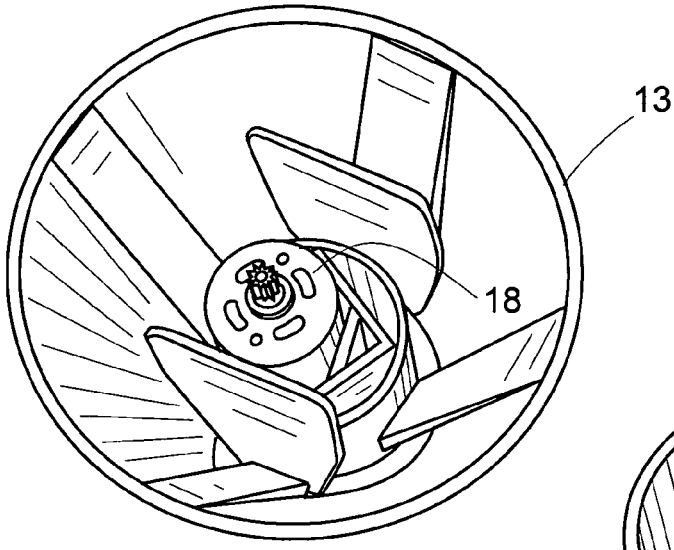
FIG. 9 is a closeup view of a fragment of the apparatus according to FIG. 1, showing a portions of the drive motor with its gear box removed.
Figure 10:
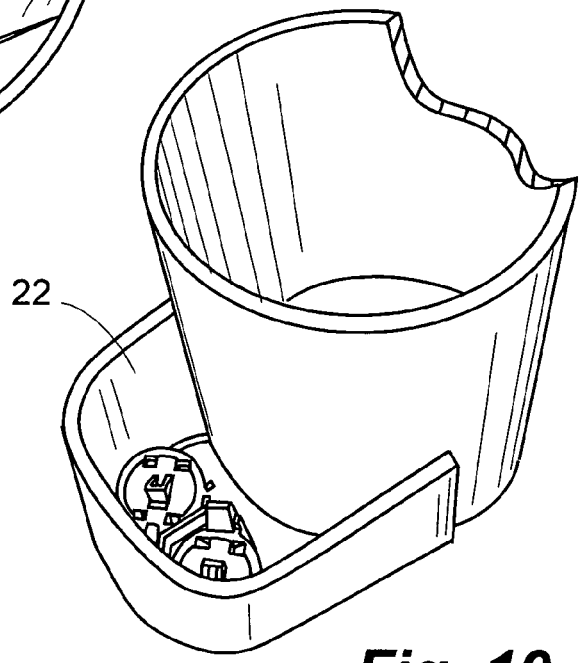
FIG. 10 is a closeup view of a fragment of the apparatus according to FIG. 1 showing the battery holder with the batteries removed.
Figure 11:
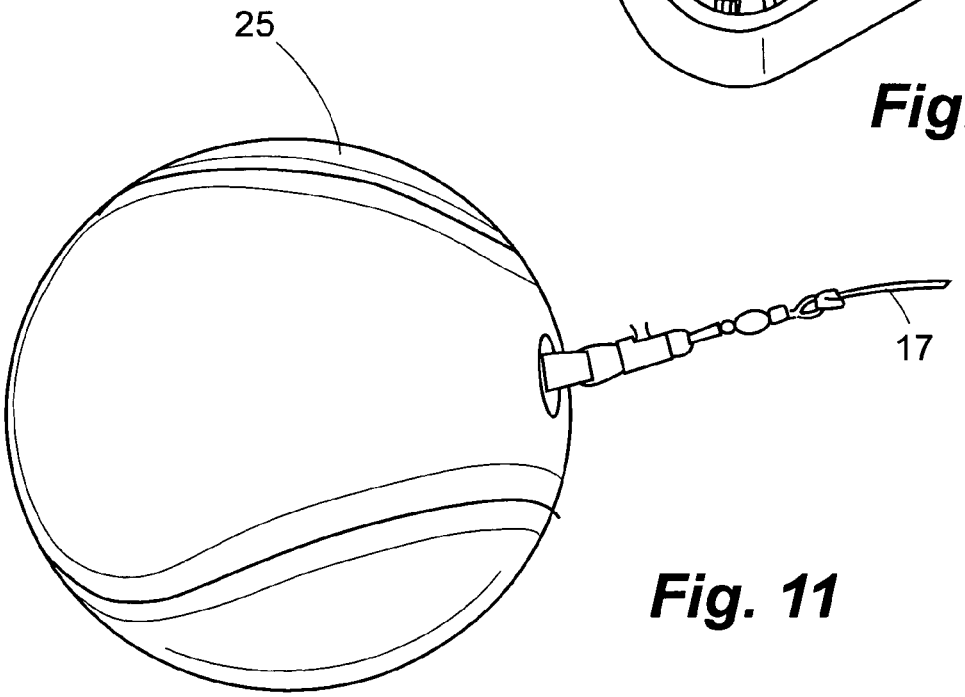
FIG. 11 is a closeup view of a fragment of the apparatus according to FIG. 1, showing the ball attached to the line.

According to one embodiment of the present invention, parts of a battery powered drill, Black & Decker Versa Pack Model VP870, Type 1, make up the motor 18, drive train 19, control 26, battery holder 22, and battery 21. The reel 16 in this embodiment is a modified fishing reel Model 808 made by Zebco. The reel 16 includes a release button 30 trimmed to fit inside the upper housing 14. The button 30 can be activated outside the upper housing 14 with the use of a plug 31 protruding therefrom which is slideably mounted within a hole defined by the upper housing (FIGS. 1-3). Modified so that it lacks its standard rewind handle, the reel 16 includes a shaft 29 of this handle which is directly attached to the motor drive train 19 as shown in FIG. 8. Alternate embodiments have similar parts which are available from many sources. The structural elements of the prototype are made from steel, but aluminum or plastic can also be used.

What is claimed:

1. An apparatus for supporting a tethered baseball in position for batting practice and retrieving the baseball after it has been hit with a bat, comprising:

(a) a hollow structure and a ball support for holding the baseball, the ball support being connected to and positioned above the hollow structure;

(b) a modified fishing reel having a line attached to the reel, the end of the line distal from the reel being attached to the baseball, the reel being housed in the hollow structure, an opening defined in the hollow structure for receiving the line extending between the reel and the baseball; the baseball being placed on the ball support prior to being hit, wherein said end of the line extends downwardly from the baseball to said opening in the hollow structure;

(c) a motor for rewinding the line onto the reel, the motor being connected to the reel; and (d) means for activating the motor so as to retrieve the baseball.

2. The apparatus according to claim 1, which further comprises a switch for controlling the speed of the motor, so that the motor can be run at a faster speed when the baseball is far from the reel and at a slower speed when the baseball is close to the reel.

3. The apparatus according to claim 2, which further comprises a foot pedal for activating the switch.

4. The apparatus according to claim 1, wherein the hollow structure includes an upper housing from which the ball support extends upwardly, the upper housing being streamlined in shape and generally resembling a football, so that contact between a bat and the hollow structure can be minimized during the batting practice.

* * * * *